United States Patent [19]

Lissoni

[11] Patent Number: 4,658,563

[45] Date of Patent: Apr. 21, 1987

[54] PACKAGING MACHINE WITH A FRAME OF STIFFENED STRUCTURE

[75] Inventor: Adelio Lissoni, Vedano Olona, Italy

[73] Assignee: S.I.A.T. Societa Internazionale Applicazioni Tecniche S.p.A., Turate, Italy

[21] Appl. No.: 783,445

[22] Filed: Oct. 3, 1985

[30] Foreign Application Priority Data

Oct. 5, 1984 [IT] Italy ..... 23039 A/84

[51] Int. Cl.[4] ..... B65B 57/00

[52] U.S. Cl. ..... 53/137; 493/117; 493/478

[58] Field of Search ..... 53/137, 374; 493/478, 493/479, 477, 117, 116

[56] References Cited

U.S. PATENT DOCUMENTS

| | | | |
|---|---|---|---|
| 4,041,675 | 8/1977 | Loveland et al. | 53/374 |
| 4,161,138 | 7/1979 | Marchetti | 53/374 X |
| 4,317,319 | 3/1982 | Price | 53/374 X |
| 4,364,219 | 12/1982 | Luyett et al. | 53/374 |
| 4,545,176 | 10/1985 | Marchetti | 53/374 X |

*Primary Examiner*—James F. Coan

*Attorney, Agent, or Firm*—Young & Thompson

[57] ABSTRACT

A packaging machine, of the type comprising a bed mounted on support legs, two uprights rigidly connected to the bed and upwardly projecting therefrom, and a working head carried by the uprights. The bed comprises a rectangular box-formed sheet metal frame and two central, longitudinal, side-by-side cross-members, the constituent elements of at least part of the machine working units being mounted directly on the cross-members, and a space for housing removable roller tables being provided between these cross-members and the longitudinal sidepieces of the bed.

18 Claims, 10 Drawing Figures

PACKAGING MACHINE WITH A FRAME OF STIFFENED STRUCTURE

BACKGROUND OF THE INVENTION

Machines are commercially available for sealing packaging boxes by automatically applying adhesive tape, commonly known as "packaging machines". A machine of this type, of relatively simple structure, comprises essentially a bed incorporating conveying means for feeding the boxes to be sealed, and/or means for applying the adhesive tape, and a pair of uprights projecting upwards from the bed and supporting a working head which operates downwards on the boxes and which also comprises conveying means and/or means for applying the adhesive tape.

Normally, the bed is formed from a rectangular main frame comprising a central space for housing self-contained, self-supporting, work units-for example and conveying and/or taping units, already mounted on their own support frame-and having slide roller mounted laterally. Uprights are also fixed to the frame sidepieces and project upwards to support the upper working head.

Such a construction is not generally satisfactory because:

if repair or maintenance work has to be carried out on the central conveying and/or taping unit, this unit has to be completely removed from the frame and remounted after repair;

the main frame is subjected to considerable loads, including moving loads, so that it easily undergoes torsional bending, particularly when it does not rest perfectly flat on the floor.

In an attempt to obviate at least part of these drawbacks, it has already been proposed to mount the conveying and/or taping unit not on the frame sidepieces, as in the known art, but on brackets projecting from the frame endpieces, so as to leave a free space to the sides of said unit, this space being covered by removable plates.

This emthod has the advantage of facilitating at least one of the maintenance operations, i.e. the replacement of the wearable conveyor belts-when these are of the endless type-by drawing them out frm the open sides and thus without removing the head. This method is not however free from complications as it requires removable plates to be used instead of lateral slide rollers, with obvious increase in friction, and it also further overloads the frame through the weight of the end support brackets.

Moreover, it does not solve all the other maintenance and/or repair problems, for which it is still essential to remove the head from the frame, neither does it solve the problems deriving from the poor frame rigidity, and if anything aggravates them.

However, in order to solve these problems of frame resistance to torsional stresses, there is currently no other way than to construct the frame of thicker and stronger iron sections, obviously to the detriment of the lightness and manageability of the entire machine, and increasing its cost.

SUMMARY OF THE INVENTION

The object of the present invention is to provide a simplified frame structure which is light but very rigid, is of lower cost, and is more easily adaptable to different manufacturing requirements. This result is attained in that the bed consists of a rectangular box-formed sheet metal frame and two central, longitudinal, side-by-side cross-members, the constituent elements of at least part of the machine working units being mounted directly on said cross-members, and a space for housing removable roller tables being provided between these cross-members and the longitudinal sidepieces of the bed.

BRIEF DESCRIPTION OF THE DRAWINGS

Further characteristics and advantages of the machine according to the present invention will be apparent from the description given hereinafter of a preferred embodiment thereof, illustrated by way of example on the accompanying drawings, in which.

DESCRIPTION OF THE PREFERRED EMBODIMENTS

Figure 1:
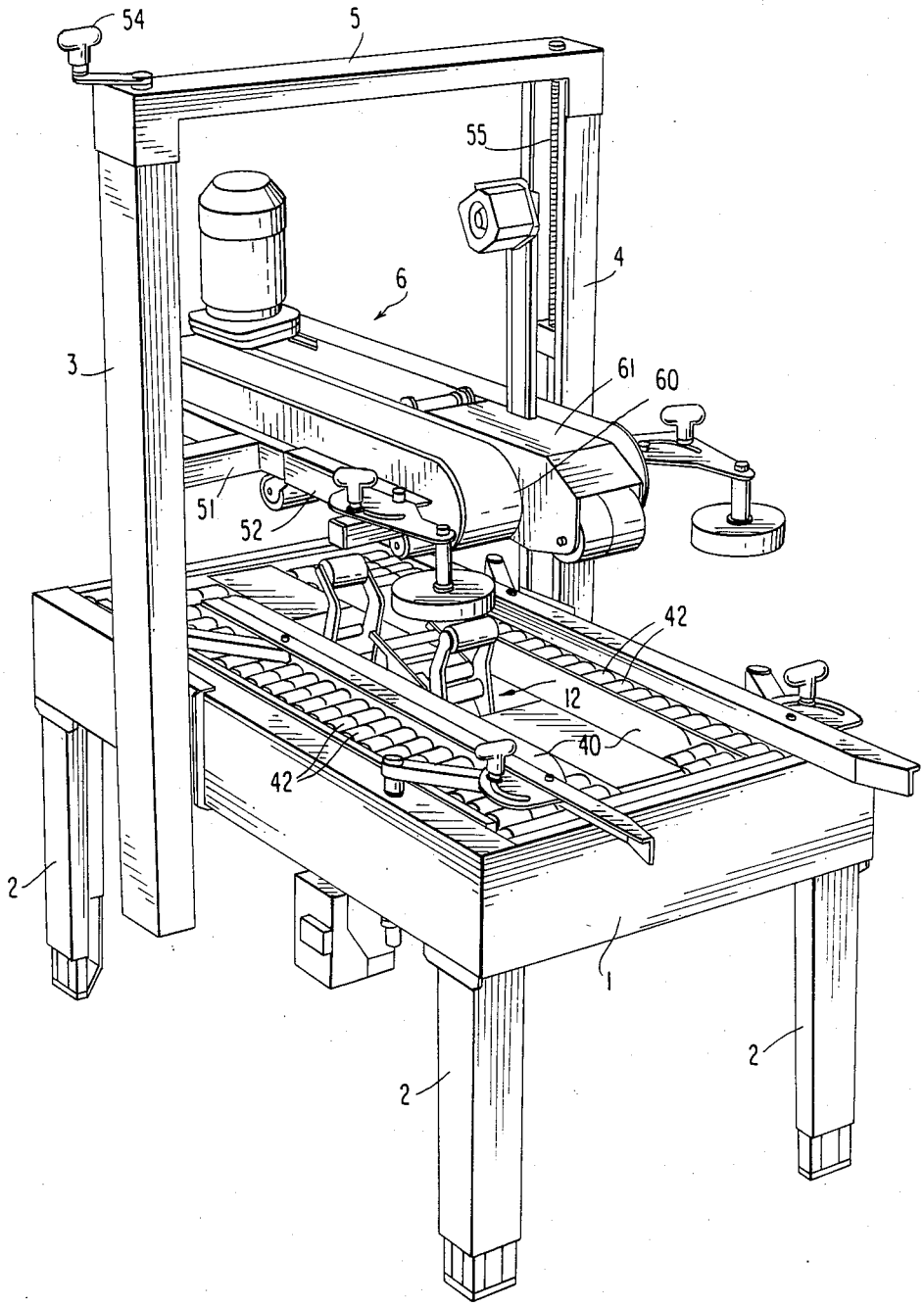
FIG. 1 is a diagrammatic overall perspective view of the packaging machine according to the present invention.

As can be seen, the machine according to the invention comprises a bed 1 which is mounted on four legs 2 adjustable in height, and on which are fixed to lateral uprights 3 and 4 joined together at their upper end by a cross-member 5 and carrying an upper working head 6 which is adjustable in height.

Figure 2:
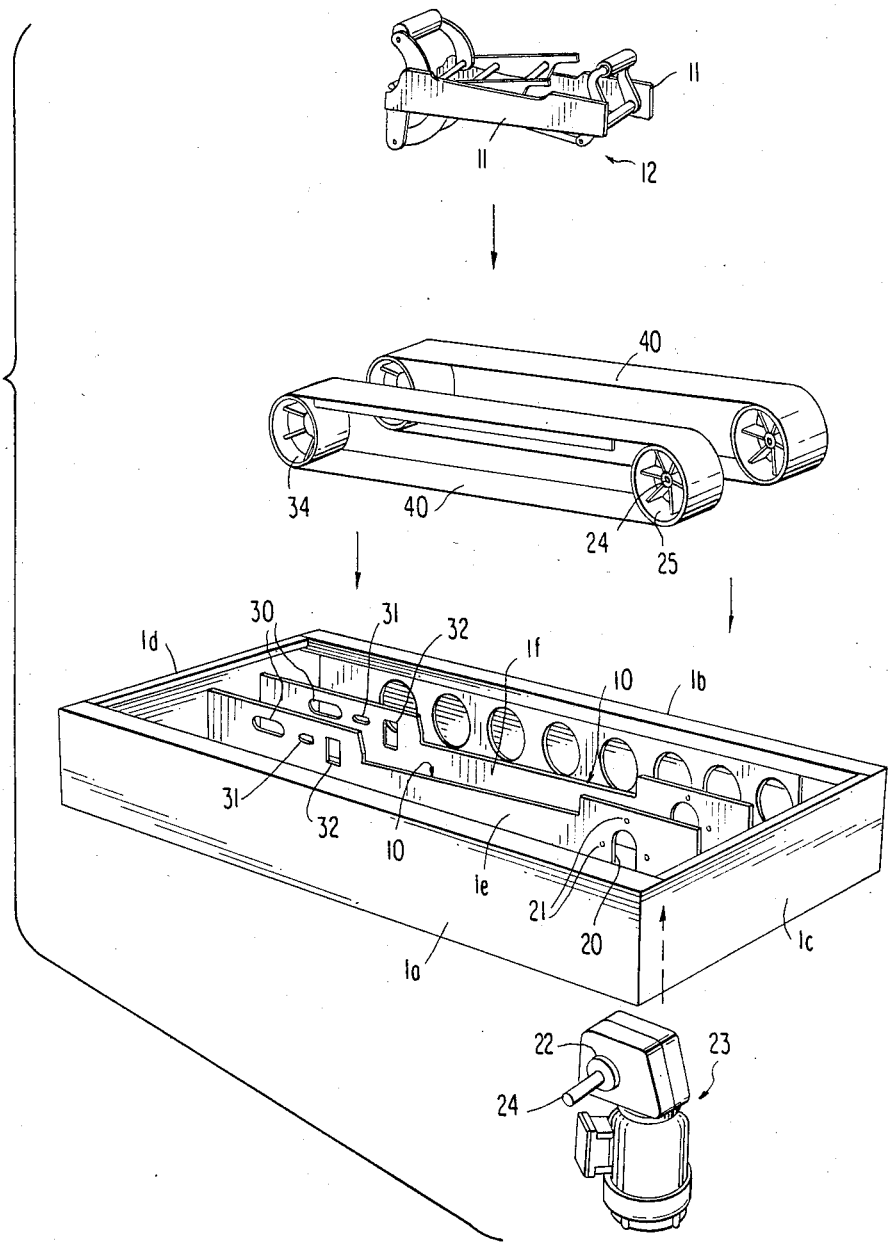
FIG. 2 is a diagrammatic perspective exploded view of the bed and certain elements carried by it.
Figure 3:
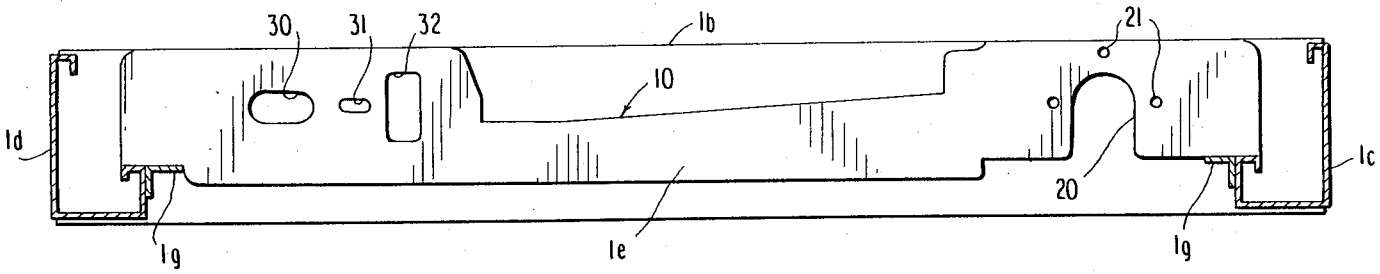
FIGS. 3 and 4 are two views of the bed, namely a longitudinal section and a cross-section respectively.
Figure 4:
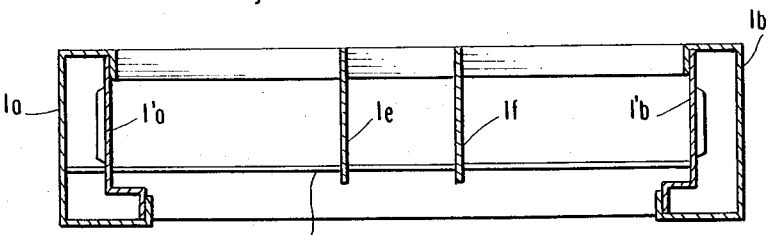

According to the present invention, and as clearly shown in FIGS. 2 to 4, the bed frame is formed from two longitudinal sidepieces 1*a*, 1*b* and two endpieces 1*c*, 1*d* of box-formed sheet metal, and from two substantially central longitudinal cross-members 1*e*, 1*f*. At least the siedpieces 1*a* and 1*b* are of closed tubular cross-section, obtained preferably by welding-on a further two box-formed sheets 1'*a* and 1'*b*, respectively to the sheets 1*a* and 1*b*.

This frame defines a central space lying between the cross-members 1*e*, 1*f*, to house in particular the taping unit of the machine, plus two lateral spaces lying between the cross-member 1*e* and sidepiece 1*a* and between the cross-member 1*f* and sidepiece 1*b*, to house in particular the conveying means and/or roller tables, described in detail hereinafter.

Again according to the present invention, the cross-members 1*e*, 1*f* are in the form of sufficiently rigid flat plates-for example obtained from sheet metal having a thickness of 5 to 6 mm-in which profiled apertures or recesses are formed, wherein the component elements of the machine working units are directly housed and/or fixed.

More precisely, each of the cross-members 1*e*, 1*f* comprises a central aperture or recess 10, in which one of the correspondingly shaped connection plates 11 of the taping unit 12 is housed (FIG. 2).

According to an advantageous characteristic of the present invention, as the plates 11 fit exactly into the apertures 10, they maintain this position simply through the effect of the insertion-fit and through their own weight, without any other means for fixing said units 12 to the cross-members 1*e*, 1*f* being necessary.

This arrangement also offers further advantages:

firstly, the extreme ease with which the taping unit 12 can be inserted into and drawn out from its seat 10, means that it can be removed from the bed whenever an empty roll of adhesive tape is to be replaced, thus making this operation much simpler;

secondly, the plates 11 occupy a transverse space which coincides with the space already occupied by the cross-members 1*e*, 1*f*. Thus these latter do not have to be spaced apart by more than the width of the taping unit 12-in contrast to the known art- with the advantage of a reduction in transverse dimensions.

Figure 7:
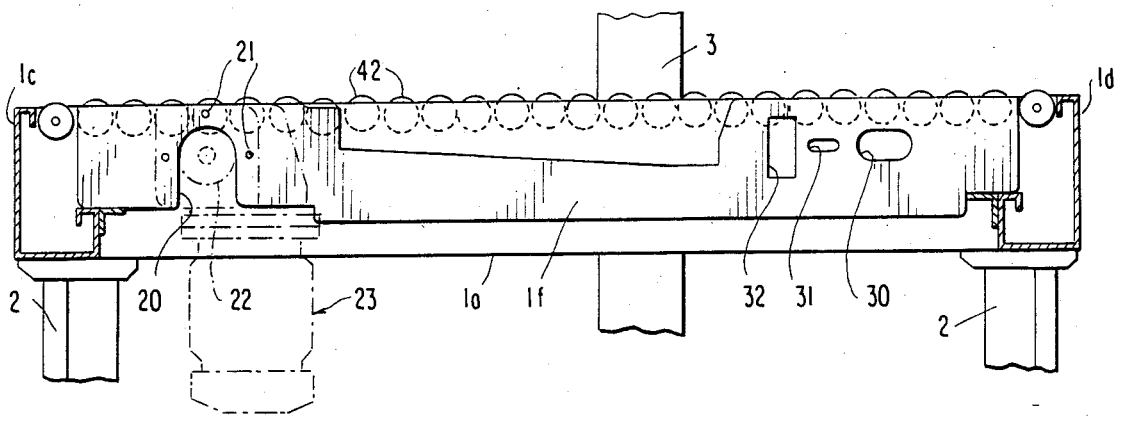

The cross-members 1*e*, 1*f* also comprise downwardly open apertures 20 surrounded by several fixing holes 21. The apertures 20 house the collars 22 of a drive unit 23, which is inserted from the bottom upwards, As can also be clearly seen from FIG. 7, the unit 23 is fixed between the cross-members 1*e*, 1*f* by screws which cross the holes 21. As described in detail hereinafter, the drive rollers 25 for the conveying unit are mounted on the shafts 24, which emerge laterally from the unit 23 and project from the cross-members 1*e*, 1*f* in the direction of the sidepieces 1*a*, 1*b*.

Figure 9:
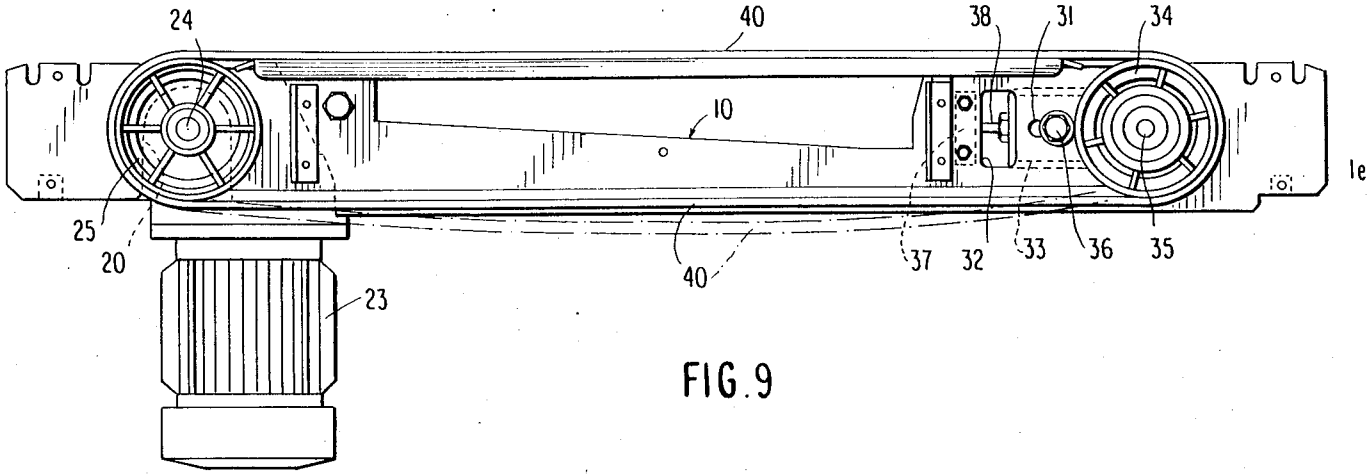
FIGS. 8 and 9 are two diagrammatic views, namely a plan and a side view respectively, of the conveying means mounted on the central part of the bed.
Figure 8:
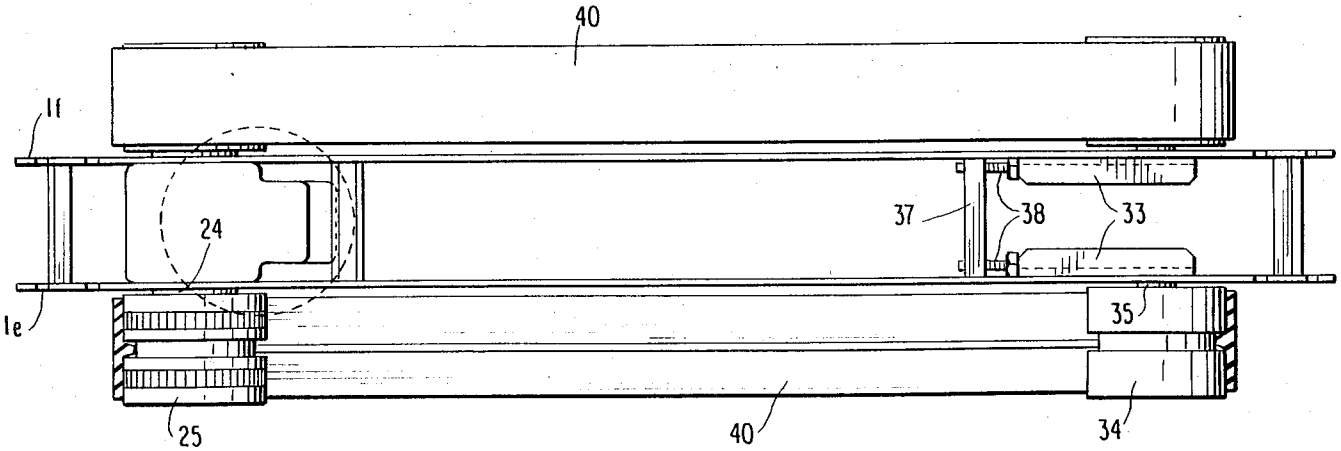

The cross-members 1*e*, 1*f* also comprise apertures 30, 31 and 32 for mounting the tensioning unit 33 for the return rollers 34 of the conveyor belts 40. A unit 33 is disposed on the inner side of each of the cross-members 1*e*, 1*f*, as can be seen in FIGS. 8 and 9.

Each unit comprises a slide 33, from which a pin 35 for supporting the idler return roller 34 projects outwards from the cross-member. This pin passes through the aperture 30, which is in the form of a horizontally elongated slot. The slide 33 also comprises a passage hole for a bolt 36, which passes through the aperture 31 also formed as a horizontally elongated slot, to engage a corresponding nut. By virtue of this mounting arrangement, the slide 33 can move horizontally with a certain slack, at least until the bolt 36 is tightened by its nut.

Just to the side of the rectangular-shaped aperture 32, on the side opposite to the aperture 31, there is provided a bridge 37 which is fixed to the two cross-members 1*e*, 1*f*. Threaded bores, into which adjustment bolts 38 are screwed, are provided in this bridge, in a position close to the inner wall of the cross-members 1*e*, 1*f*. As the bolts 38 are thus very close to the wall 1*e* or 1*f*, the wide head of each of them is housed laterally in the aperture 32. By means of a key which engages in the aperture 32, the bolt 38 can be rotated in the threaded bore provided in the bridge 37, so as to vary its position relative to this bridge. The end of the slide 33 rests against the head of the bolt 38 under the thrust of the tensioned conveyor belts, as can be seen in FIGS. 8 and 9.

The two conveyor belts are each very simply assembled. After fixing the drive unit 23 in the aperture 20, the drive rollers 25 are mounted on the output shaft 24. The slide 33 of the tensioning unit is then mounted, while leaving the bolt 36 slack. The conveyor belt 40 is then mounted over the drive rollers 25 and over the return rollers 34. The bolt 38 is rotated so that it moves- and with it the slide 33 and consequently the return rollers 34-in the opposite direction to the drive rollers 25, until the belt 40 is under the correct tension. The bolt 36 is then tightened, so as to finally lock the slide 33 in the required position.

Figure 6:
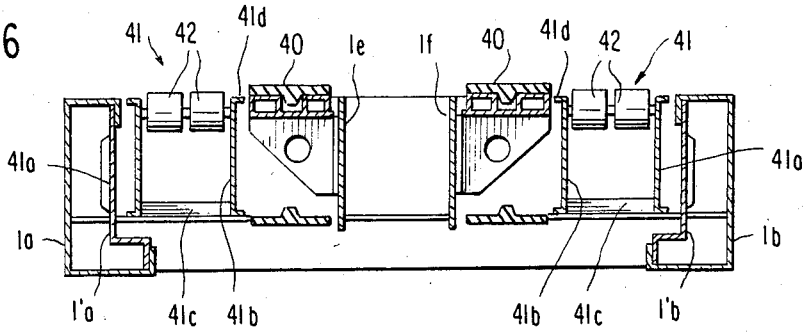
FIGS. 5, 6 and 7 are a plan, a cross-sectional and a longitudinal section view respectively, of the bed with certain parts mounted on it.
Figure 5:
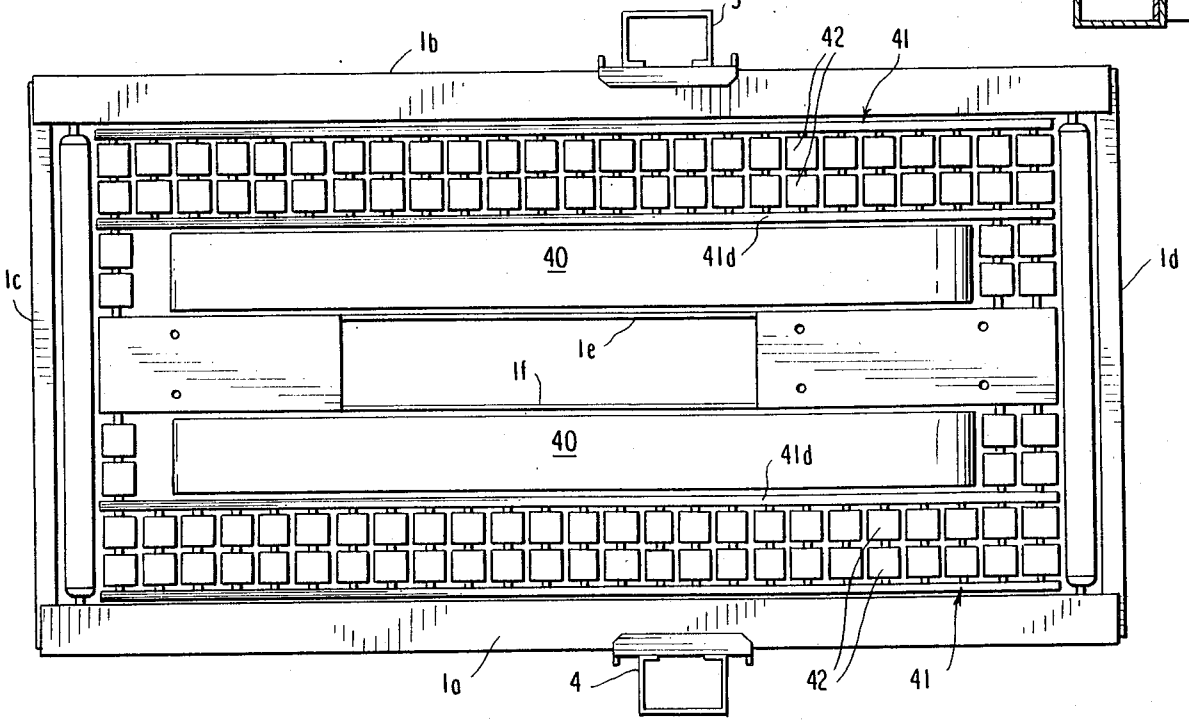

As can be seen from FIGS. 1, 5 and 6 in particular, removable roller tables 41 are housed between the longitudinal cross-members 1*e*, 1*f* and the sidepieces of the bed. Each of these roller tables is formed from two longitudinal sidepieces 41*a* and 41*b* which are joined together by spacer bars 41*c*, and have idle slide rollers 42 mounted at their top.

According to an interesting aspect of the present invention, the roller tables 41 simply rest on a ledge 1*g* (FIG. 7) projecting inwards from the endpieces 1*c*, 1*d* of the bed, so that they can be easily withdrawn upwards. If desirable, simple fixing means such as a screw or the like can also obviously be provided.

The roller tables are exactly positioned in the spaces between the sidepieces 1*a*, 1*b* and the cross-members 1*e*, 1*f*, so that the upper edges 41*d* of the inner sidepieces 41*b* are also able to act as a protection guard for the belts 40.

As already stated, the bed frame structure described heretofore has at least the following advantages:

firstly, it is very rigid, particularly by virtue of the box-formed sheet metal structure of the endpieces and sidepieces, these latter being of tubular cross-section, which makes it very stable;

it is also less stressed, in that the working units are directly mounted on said rigid frame without the need for their own support frames, and thus without the burden of superfluous loads;

moreover, electric cables, compressed air feed pipes and other services can be housed in the tubular sidepieces of the bed without the need to provide special fixing means or ducts for them;

finally, it has considerable practical advantages with regard to the ease of assembly of the compact elements of the working units on the frame, and the ease of access to the various parts for replacing empty adhesive tape rolls, and for maintenance and/or repair work.

A further important characteristic of the invention lies in the structure of the support uprights for the upper working head. Firstly, as can be seen from FIG. 1, the upper ends of the uprights, 3, 4 are joined together by a cross-member 5, which stiffly connects the two uprights into a bridge structure. Because of this, and by virtue of the rigid fixing of the uprights 3, 4 on the bed 1, this bridge structure itself contributes to stiffening the structure of the entire machine.

Figure 10:
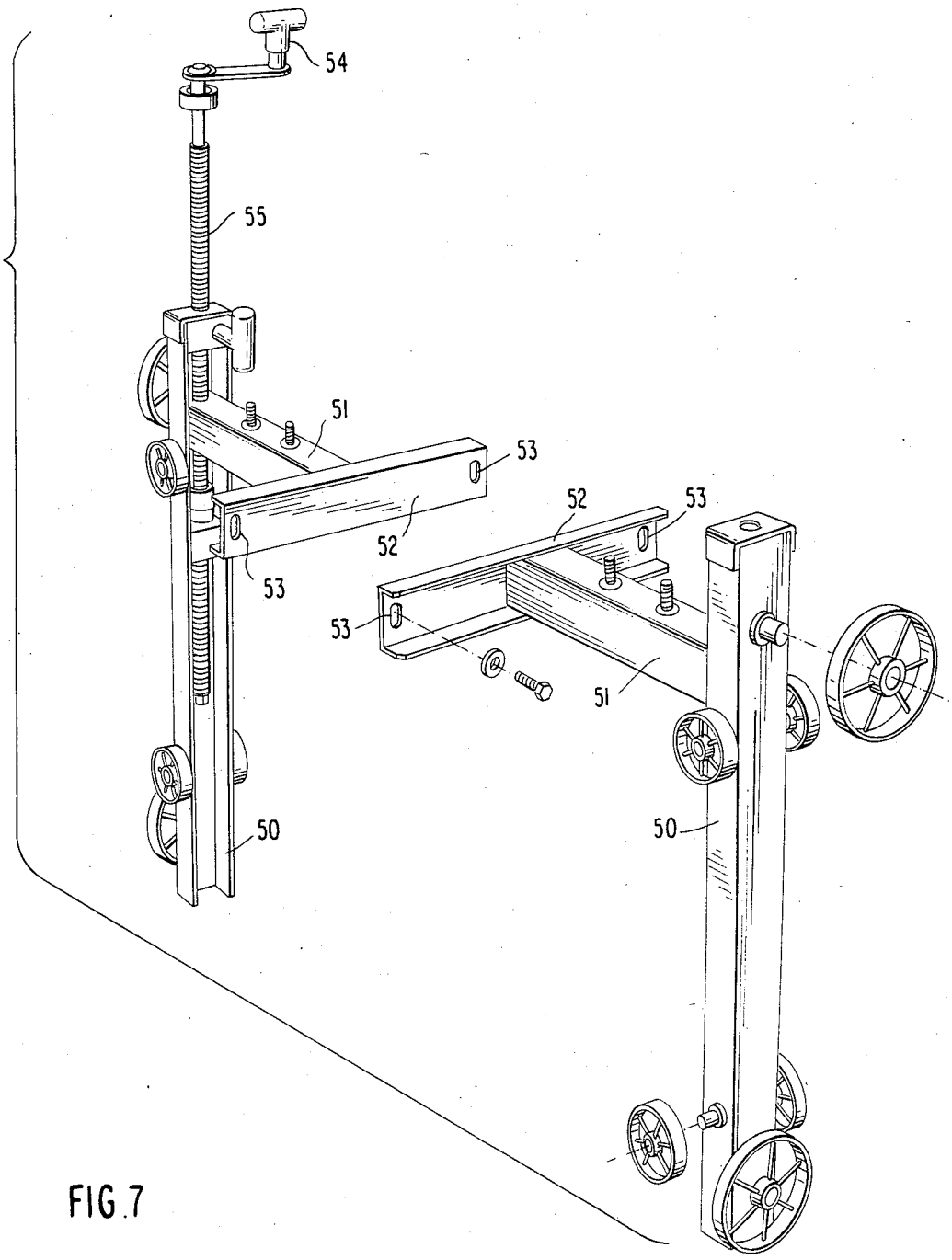
FIG. 10 is a very diagrammatic perspective view of the two lateral support uprights for the upper head.

According to a further aspect of the invention, and as can be seen in FIG. 10, in each of the uprights 3, 4 there is slidably mounted a carriage 50 from which an arm 51 projects towards the centre of the machine and terminates with a support bar 52 for the head 6. The two carriages 50, the relative arms 51 and bars 52 constitute indentical units, which are mounted on the uprights 3, 4 in specular symmetry. The head 6 is fixed on the bars 52 by bolts which pass through holes 53 in the form of vertically elongated slots.

Compared with the known art-in which the support frame is made to measure for a specific working head and is rigidly connected to carriages mobile along the lateral uprights-the head support and mounting system described heretofore has many advantages:

firstly, heads of different type can be mounted with the widest possible interchangeability on the bars 52, because the configuration of the support frame no longer represents a constraint;

moreover, the fixing through slotted holes 53 allows adjusting the horizontal alignment of the head 6, to take account of any inclination of the bars 52, following any bending which may be produced on the arms 51 and bars 52 by the weight of said head;

furthermore, it is much simpler to assemble the carriages 50 in the respective uprights 3 and 4, as said carriages are completely independent one from the other during this assembly;

the fact that the carriages are of identical structure simplifies their construction and reduces storage problems;

finally, the overall machine structure is further lightened.

Each of the carriages 50 is slidably mounted in the upright 3 or 4 and their movement is controlled by worms 55, according to a known technique. To move the carriages, the worms 55 are rotated for example by a handle 54 rigidly connected to the upper end of one of the worms 55, and by way of a drive-for example in the form of a toothed belt, chain or transmission shaft with bevelled gear pairs-which connects together the two worms 55 so that they rotate simultaneously.

According to an advantageous characteristic of the invention, the drive is housed in the upper cross-member 5. As the cross-member 5 is downwardly open, this arrangement allows easy access to the drive for maintenance or repair, and also has the advantage of eliminating any connection between the uprights 3 and 4 below the bed 1.

Finally, according to a further characteristic of the invention, the upper working head comprises an upwardly open free space 60 (indicated by dashed lines in FIG. 1) which can house tools and spare parts for the machine, as required for ordinary machine maintenance. This space is closed by a cover 61, which is in line with the upper face of the head and therefore represents no encumberance during normal use.

The invention has been described heretofore in terms of a preferred embodiment, but numerous constructional modifications can be made thereto, all within the range of an expert of the art, but all falling within the protective scope of the invention itself.

I claim:

1. A packaging machine, of the type comprising a bed mounted on support legs, two uprights rigidly connected to the bed and projecting upwards therefrom, and a working head carried by said uprights, characterized in that the bed consists of a rectangular box-formed sheet metal frame and two central, longitudinal, side-by-side cross-members, the constituent elements of at least part of the machine working units being mounted directly on said cross-members, and a space for housing removable roller tables being provided between these cross-members and the longitudinal sidepieces of the bed, said longitudinal cross-members consisting of sheet metal plates fixed at their ends to the minor sides or endpieces of the rectangular frame.

2. A packaging machine as in claim 1, wherein the rectangular box-formed sheet metal frame comprises two endpieces substantially of C-shaped cross-section, and two sidepieces of closed tubular cross-section.

3. A packaging machine as in claim 1, wherein the slidable support carriages are moved in known manner by worm screws mounted rotatably but not slidably in said uprights, means being also provided for synchonising the rotation of the two worms.

4. A packaging machine as in claim 1, wherein said longitudinal plate cross-members comprise at least one recess or aperture for housing a correspondingly shaped part of an interchangeable working device.

5. A packaging machine as in claim 4, wherein said working device is a taping unit, the sidepieces of which are configured in such a manner as to exactly fit into said housing apertures or recesses in the plate cross-members.

6. A packaging unit as in claim 1, wherein said working device is a conveying unit comprising, at one end, a geared motor with a first pair of drive rollers, and at its other end, a pair of position-adjustable mobile carriages, each carrying an idle return roller, conveyor belts being mounted on said rollers.

7. A packaging machine as in claim 6, wherein each of said mobile carriages consists of a plate from which projects the support pin for a return roller, said pin passing through an aperture in the longitudinal cross-members, the position of said plate being determined by a longitudinal adjustment bolt, the head of which serves as an abutment against which the plate rests under the thrust determined by the tensioning of the conveyor belts.

8. A packaging machine as in claim 3, wherein said synchronising means consist of a drive housed in said upper connection cross-member.

9. A packaging machine as in claim 1, wherein said upper working head comprises a space for containing working tools and/or spare parts.

10. A packaging machine as in claim 9, wherein said space is closed by a cover having its surface in line with the upper surface of the head.

11. A packaging machine as in claim 1, wherein the lateral support uprights for the upper working head are joined together at their upper end by a stiffening cross-member.

12. A packaging machine as in claim 1, wherein each of the lateral uprights houses, in known manner, a slidable support carriage for the upper working head, a connection arm for the working head projecting towards the centre of the machine from each carriage.

13. A packaging machine as in claim 12, wherein the working head is interchangeable on said connection arms of the slidable support carriages.

14. A packaging machine as in claim 12, wherein said connection arms terminate with longitudinal bars, the working head being mounted on said bars by way of means for adjusting the inclination of the head in respect to the horizontal plane.

15. A packaging machine as in claim 12, wherein the slidable support carriages are identical and are mounted on said uprights in specular symmetry, independently one from the other.

16. A packaging machine, of the type comprising a bed mounted on support legs, two uprights rigidly connected to the bed and projecting upwards therefrom, and a working head carried by said uprights, characterized in that the bed consists of a rectangular boxformed sheet metal frame and two central, longitudinal, side-by-side cross-members, the constitutent elements of at least part of the machine working units being mounted directly on said cross-members, and a space for housing removable roller tables being provided between these cross-members and the longitudinal sidepieces of the bed, each roller table consisting of a pair of sidepieces joined together by respective spacer means and having idle rollers mounted thereon, each roller table resting, by the ends of its sidepieces, on endpieces of the bed.

17. A packaging machine as in claim 16, wherein the bed endpieces comprise, in the lower part, inwardly projecting edges on which the ends of said roller table sidepieces rest.

18. A packaging machine as in claim 16, wherein the inner sidepieces of each roller table form a protection guard for the conveyor belts.

* * * * *